US011697197B2

(12) United States Patent
Cheylus et al.

(10) Patent No.: US 11,697,197 B2
(45) Date of Patent: Jul. 11, 2023

(54) HYDRAULIC ROTARY-PERCUSSIVE HAMMER DRILL PROVIDED WITH A STOP PISTON

(71) Applicant: MONTABERT, Saint-Priest (FR)

(72) Inventors: François-Xavier Cheylus, Lyons (FR); Michel Escolle, Nievroz (FR)

(73) Assignee: MONTABERT, Saint-Priest (FR)

( * ) Notice: Subject to any disclaimer, the term of this patent is extended or adjusted under 35 U.S.C. 154(b) by 0 days.

(21) Appl. No.: 17/682,931

(22) Filed: Feb. 28, 2022

(65) Prior Publication Data

US 2022/0274240 A1 Sep. 1, 2022

(30) Foreign Application Priority Data

Mar. 1, 2021 (FR) ..... 21/01949

(51) Int. Cl.

| | |
|---|---|
| ***E21B 1/38*** | (2006.01) |
| ***E21B 6/00*** | (2006.01) |
| ***B25D 9/14*** | (2006.01) |
| ***B25D 17/06*** | (2006.01) |

(52) U.S. Cl.

CPC ..... *B25D 9/145* (2013.01); *B25D 17/06* (2013.01); *E21B 1/38* (2020.05); *E21B 6/00* (2013.01); *B25D 2209/002* (2013.01); *B25D 2217/0023* (2013.01)

(58) Field of Classification Search

CPC ..... E21B 1/38; E21B 1/00; E21B 1/02; E21B 1/12; E21B 6/00

See application file for complete search history.

(56) References Cited

U.S. PATENT DOCUMENTS

| | | | | |
|---|---|---|---|---|
| 2,298,720 | A * | 10/1942 | O'farrell | E21B 19/086 251/321 |
| 3,216,510 | A * | 11/1965 | Briden | E21C 27/32 173/15 |
| 4,594,885 | A * | 6/1986 | Rodger | E21B 7/24 73/864.45 |
| 5,479,996 | A * | 1/1996 | Jonsson | E21B 44/06 175/135 |
| 2006/0069395 | A1* | 3/2006 | Lebet | A61B 17/22012 606/127 |
| 2018/0216430 | A1* | 8/2018 | Stewart | E21B 34/08 |
| 2021/0001462 | A1 | 1/2021 | Comarmond | |

FOREIGN PATENT DOCUMENTS

| | | | |
|---|---|---|---|
| EP | 0648915 | A1 | 4/1995 |
| FR | 3077752 | A1 | 8/2019 |
| WO | 2007073275 | A1 | 6/2007 |
| WO | 2010082871 | A1 | 7/2010 |

* cited by examiner

*Primary Examiner* — Shane Bomar
(74) *Attorney, Agent, or Firm* — Cantor Colburn LLP

(57) ABSTRACT

The hydraulic rotary-percussive hammer drill includes a body; a shank; a striking piston configured to hit the shank; a stop piston configured to position the shank in a predetermined balanced position, the body and the stop piston delimiting a first control chamber permanently connected to a high-pressure fluid feed-in conduit and configured to urge the stop piston forwards, and a second control chamber configured to urge the stop piston forwards. The hydraulic rotary-percussive hammer drill comprises a fluidic communication channel opening into the second control chamber, configured to supply the second control chamber with high-pressure fluid and provided with a calibrated orifice.

20 Claims, 3 Drawing Sheets

HYDRAULIC ROTARY-PERCUSSIVE HAMMER DRILL PROVIDED WITH A STOP PISTON

CROSS REFERENCE TO RELATED APPLICATIONS

This application claims priority under 35 U.S.C. § 119 to the following French Patent Application No. 21/01949, filed on Mar. 1, 2021, the entire contents of which are incorporated herein by reference thereto.

TECHNICAL FIELD

The present invention relates to a hydraulic rotary-percussive hammer drill used more specifically on a drilling rig.

BACKGROUND

A drilling rig comprises, in a known manner, a hydraulic rotary-percussive hammer drill slidably mounted on a slide and driving one or several drill bar(s), the last one of these drill bars carrying a tool called cutter which is in contact with the rock. In general, such a hammer drill is intended to drill substantially deep holes in order to be able to place explosive loads therein. Hence, the hammer drill is the main element of a drilling rig which, on the one hand, imparts on the cutter the rotational and the percussion through the drill bars so as to penetrate the rock, and on the other hand, supplies an injection fluid so as to extract the debris from the drilled hole. More particularly, a hydraulic rotary-percussive hammer drill comprises on the one hand a striking system which is driven by one or several flow rate(s) of hydraulic fluid originating from a main hydraulic feed-in circuit and which comprises a striking piston configured to hit, at each operating cycle of the hammer rill, a shank coupled to the drill bars, and on the other hand a rotation system provided with a hydraulic rotary motor and configured to set the shank and the drill bars in rotation.

In order to keep the cutter bearing against the rock, a pushing force is generally applied by the slide on the hydraulic rotary-percussive hammer drill. Advantageously, the pushing force is generated by the slide mainly thanks to a drive cable or chain, primarily driven by a hydraulic cylinder or a hydraulic motor.

The aforementioned pushing force is transmitted from the hydraulic rotary-percussive hammer drill to the cutter through the shank and the drill bars. More specifically, the pushing force is transmitted from the body of the hammer drill to the shank through a stop element incorporated in the body of the hammer drill. This stop element may be constituted, for powerful hammer drills, by a stop piston at least one surface of which is hydraulically fed so as to ensure a transmission of the pushing force by means of a fluid. The pushing force should also partially compensate for the recoil force of the hammer drill which is primarily caused by the striking pressure and the striking frequency of the striking piston and which increases with these parameters. Ultimately, the cutter is pressed against the rock substantially only by the difference between the pushing force and the recoil force, as well as by the force exerted by the stop piston on the shank.

The stability and the penetration speed performance of a hydraulic rotary-percussive hammer drill, when it operates, depend in particular on the way in which the stop piston is disposed and hydraulically fed.

The document WO2010/082871 discloses a hydraulic rotary-percussive hammer drill wherein, in the operating conditions of the striking system, the stop piston is positioned in a balanced position, in accordance with a desired striking stroke of the striking piston, through a hydraulic control chamber delimited by the striking piston and the body of the hammer drill and permanently connected to a high-pressure fluid feed-in conduit, the hydraulic control chamber being configured on the one hand to urge the stop piston forwards and on the other hand to be connected to a low-pressure fluid return conduit when the rear face of the stop piston is located at a predetermined distance from the rear wall of the cavity receiving the stop piston.

The configuration of the stop piston and of the body described in the document WO2010/082871 allows ensuring a substantially stable positioning of the stop piston during the operation of the striking system, around a predetermined optimum work position.

However, the vibrations and reactions of the rock to the repeated hits of the cutter make the bearing force of the tool of the drill bar on the rock unstable, in particular during the movements of the tool due to the penetration of the drill bar into the ground and the various vibrations of the body of the hammer drill. Yet, such instability of the bearing force of the cutter on the rock is detrimental to the positioning of the shank with respect to the striking piston and therefore to the performances of the hydraulic hammer drill.

BRIEF SUMMARY

The present invention aims at overcoming all or part of these drawbacks.

Hence, the technical problem at the origin of the invention consists in providing a hydraulic hammer drill which has a simple and economic structure, while having improved performances.

To this end, the present invention concerns a hydraulic rotary-percussive hammer drill comprising:

- a body,
- a shank intended to be coupled to at least one drill bar equipped with a tool,
- a striking piston slidably mounted inside the body along a striking axis and configured to hit the shank,
- a stop piston which is slidably mounted in a cavity of the body according to an axis of displacement substantially parallel to the striking axis, the stop piston including a front face facing the shank and configured to position the shank in a predetermined balanced position with respect to the striking piston, and a rear face opposite to the front face and located opposite a rear wall of the cavity, and
- a high-pressure fluid feed-in conduit and a low-pressure fluid return conduit, the body and the stop piston delimiting at least partially a first control chamber permanently connected to the high-pressure fluid feed-in conduit and configured to urge the stop piston forwards, the hydraulic rotary-percussive hammer drill further comprising a connecting channel configured to fluidly connect the first control chamber to the high-pressure fluid return conduit when the rear face of the stop piston is located at a distance from the rear wall of the cavity which is larger than a predetermined value, characterized in that the body and the stop piston further delimiting at least partially a second control chamber configured to urge the stop piston forwards, and in that the hydraulic rotary-percussive hammer drill comprises a fluidic communication channel which opens into the second control chamber and which is configured to supply the second control chamber with high-pressure fluid, the fluidic communication channel being provided with a calibrated orifice.

The particular configuration of the first control chamber and of the connecting channel allows hydraulically positioning the stop piston in a substantially stable balanced position corresponding to an optimum striking stroke of the striking piston.

Furthermore, the specific configuration of the second control chamber allows, by the permanent connection of the latter with a fluidic communication channel provided with a calibrated orifice, limiting the amplitude of the recoil movement of the stop piston because the pressure in the second control chamber increases more quickly thanks to the calibrated orifice and thus limits the recoil stroke of the stop piston. Also, when the stop piston advances, the pressure in the second control chamber decreases, still thanks to the calibrated orifice, which limits the advance force applied on the stop piston, and therefore the forward displacement of the stop piston.

Thus, the specific configuration of the second control chamber allows better re-centering the stop piston around its balanced position, and therefore avoiding the stop piston advancing up to a front mechanical stop provided on the body, or the stop piston recoiling too much and coming into contact with the rear wall of the cavity receiving the stop piston. By limiting the phases of contact between the stop piston and its front mechanical stop, the hydraulic rotary-percussive hammer drill according to the present invention ensures on the one hand a better bearing, whether direct or indirect, of the stop piston on the shank and therefore an optimized hold of the cutter against the rock during the striking phases of the striking piston, which considerably limits the risks of idle hits of the shank and consequently the risks of damage of the shank, the drill bars and the cutter, and on the other hand an optimized positioning of the shank with respect to the striking piston, which confers improved performances on the hydraulic rotary-percussive hammer drill according to the present invention. In addition, by limiting the recoil stroke of the stop piston, the hydraulic rotary-percussive hammer drill according to the present invention allows on the one hand avoiding reducing the striking stroke of the striking piston (and consequently avoiding limiting the energy per hit of the hydraulic rotary-percussive hammer drill), and therefore increasing even more the performances of the hydraulic rotary-percussive hammer drill, and on the other hand avoiding the stop piston recoiling until touching the rear wall of the cavity, which might damage the body and the stop piston.

Consequently, the particular configuration of the hydraulic rotary-percussive hammer drill according to the present invention confers thereof improved performances and reliability in comparison with hydraulic rotary-percussive hammer drills of the prior art.

The hydraulic hammer drill may further have one or more of the following features, considered alone or in combination.

According to an embodiment of the invention, the second control chamber is configured to be supplied with high-pressure fluid only through the fluidic communication channel.

According to an embodiment of the invention, the fluidic communication channel includes a first end portion opening into the second control chamber and a second end portion opening into an inner chamber which is partially delimited by the body and which is configured to be permanently supplied with high-pressure fluid.

According to an embodiment of the invention, the hydraulic rotary-percussive hammer drill comprises a main hydraulic feed-in circuit configured to control an alternating sliding of the striking piston according to the striking axis.

According to an embodiment of the invention, the main hydraulic feed-in circuit is further configured to control a sliding of the stop piston according to the axis of displacement, the main hydraulic feed-in circuit including the high-pressure fluid feed-in conduit and the low-pressure fluid return conduit.

According to an embodiment of the invention, the body and the striking piston delimit at least partially a primary control chamber permanently connected to the high-pressure fluid feed-in conduit and a secondary control chamber which is antagonist to the primary control chamber, the hydraulic rotary-percussive hammer drill further including a control distributor configured to fluidly connect the secondary control chamber alternately to the high-pressure fluid feed-in conduit and to the low-pressure fluid return conduit so as to control striking and return strokes of the striking piston.

According to another embodiment of the invention, the main hydraulic feed-in circuit includes a main high-pressure fluid feed-in conduit and a main low-pressure fluid return conduit, and the body and the striking piston delimit at least partially a primary control chamber permanently connected to the main high-pressure fluid feed-in conduit and a secondary control chamber which is antagonist to the primary control chamber, the hydraulic rotary-percussive hammer drill further including a control distributor configured to fluidly connect the secondary control chamber alternately to the main high-pressure fluid feed-in conduit and to the main low-pressure fluid return conduit so as to control striking and return strokes of the striking piston.

According to an embodiment of the invention, the hydraulic rotary-percussive hammer drill comprises a secondary hydraulic feed-in circuit configured to control a sliding of the stop piston according to the axis of displacement, the secondary hydraulic feed-in circuit including the high-pressure fluid feed-in conduit and the low-pressure fluid return conduit.

According to an embodiment of the invention, the second control chamber is permanently connected to the primary control chamber via the fluidic communication channel.

According to an embodiment of the invention, the second control chamber is permanently connected to the first control chamber via the fluidic communication channel.

According to an embodiment of the invention, the stop piston includes a first annular control surface extending transversely to the axis of displacement and delimiting at least partially the first control chamber and a second annular control surface extending transversely to the axis of displacement and delimiting at least partially the second control chamber.

According to an embodiment of the invention, each of the first and second annular control surfaces is directed opposite to the shank, that is to say towards the rear wall of the cavity receiving the stop piston.

According to an embodiment of the invention, the second annular control surface has a larger surface than the surface of the first annular control surface.

According to an embodiment of the invention, each of the first and second annular control surfaces extends substantially perpendicularly to the axis of displacement.

According to an embodiment of the invention, the first annular control surface is closer to the front face of the stop piston than the second annular control surface.

According to another embodiment of the invention, the first annular control surface is farther away from the front face of the stop piston than the second annular control surface.

According to an embodiment of the invention, the body and the stop piston also delimit at least partially a third control chamber permanently connected to the low-pressure fluid return conduit, the third control chamber being antagonist to the first and second control chambers.

According to an embodiment of the invention, the third control chamber is configured to urge the stop piston rearwards, that is to say towards the rear wall of the cavity and therefore opposite to the shank.

According to an embodiment of the invention, the third control chamber is connected to the low-pressure fluid return conduit by an additional fluidic communication channel. For example, the additional fluidic communication channel could be provided with an additional calibrated orifice.

According to an embodiment of the invention, the stop piston includes the connecting channel.

According to an embodiment of the invention, the connecting channel includes a first end portion opening into the first control chamber and a second end portion opposite to the first end portion and opening into an external surface of the stop piston, the second end portion of the connecting channel being adapted to be fluidly connected to the low-pressure fluid return conduit when the rear face of the stop piston is located at a distance from the rear wall of the cavity which is larger than the predetermined value.

According to an embodiment of the invention, the body includes an annular groove opening into the cavity and permanently connected to the low-pressure fluid return conduit, the second end portion of the connecting channel being adapted to be fluidly connected to the annular groove when the rear face of the stop piston is located at a distance from the rear wall of the cavity which is larger than the predetermined value.

According to an embodiment of the invention, the connecting channel includes a first end portion opening into the third control chamber and a second end portion opposite to the first end portion and opening into an external surface of the stop piston, the second end portion of the connecting channel being adapted to be fluidly connected to the first control chamber when the rear face of the stop piston is located at a distance from the rear wall of the cavity which is larger than the predetermined value.

According to an embodiment of the invention, the hydraulic rotary-percussive hammer drill includes a feed-in channel connecting the first control chamber to the high-pressure fluid feed-in conduit, the feed-in channel being provided with a calibrated feed-in orifice.

According to an embodiment of the invention, the feed-in channel includes a spray nozzle comprising the calibrated feed-in orifice.

According to an embodiment of the invention, the calibrated orifice has a smaller passage section than that of the calibrated feed-in orifice.

According to an embodiment of the invention, the stop piston is slidably mounted around the striking piston.

According to an embodiment of the invention, the main hydraulic feed-in circuit includes a high-pressure accumulator connected to the high-pressure fluid feed-in conduit.

According to an embodiment of the invention, the main hydraulic feed-in circuit further includes a low-pressure accumulator connected to the low-pressure fluid return conduit.

According to an embodiment of the invention, the third control chamber is permanently connected to the low-pressure accumulator.

According to an embodiment of the invention, the annular groove is connected to the low-pressure accumulator.

According to an embodiment of the invention, the hydraulic rotary-percussive hammer drill further includes a stop bushing disposed axially between the shank and the front face of the stop piston.

According to an embodiment of the invention, the stop piston includes an annular bearing surface configured to abut against an annular stop surface of the body.

According to an embodiment of the invention, the annular bearing surface is inclined with respect to the axis of displacement.

According to an embodiment of the invention, the stop piston includes an annular collar including the annular bearing surface.

According to an embodiment of the invention, the annular collar delimits at least partially the third control chamber.

According to an embodiment of the invention, the annular collar includes the first annular control surface.

According to an embodiment of the invention, the annular bearing surface is configured to abut against the annular stop surface of the body when the rear face of the stop piston is located at a predetermined distance from the rear wall of the cavity, the predetermined distance being larger than the predetermined value.

According to an embodiment of the invention, the fluidic communication channel and the calibrated orifice are formed by an axial groove or an axial flattened surface which is provided on the stop piston or on the body, and which connects the first control chamber to the second control chamber.

According to an embodiment of the invention, the fluidic communication channel includes a spray nozzle comprising the calibrated orifice.

According to an embodiment of the invention, the spray nozzle is provided with two passage orifices one of which forms the calibrated orifice. Advantageously, the two passage orifices may be angularly shifted from each other by about 90° with respect to a central axis of the spray nozzle.

According to an embodiment of the invention, the first control chamber is entirely delimited by the body and the stop piston.

According to an embodiment of the invention, the first control chamber is partially delimited by the body and the stop piston.

According to an embodiment of the invention, the second control chamber is entirely delimited by the body and the stop piston.

According to an embodiment of the invention, the second control chamber is partially delimited by the body and the stop piston.

According to an embodiment of the invention, the body and the striking piston partially or entirely delimit the primary control chamber.

According to an embodiment of the invention, the body and the striking piston partially or entirely delimit the secondary control chamber.

BRIEF DESCRIPTION OF THE FIGURES

Anyway, the invention will be better understood from the following description with reference to the appended schematic drawings representing, as non-limiting examples, several embodiments of this hydraulic hammer drill.

DETAILED DESCRIPTION

Figure 1:
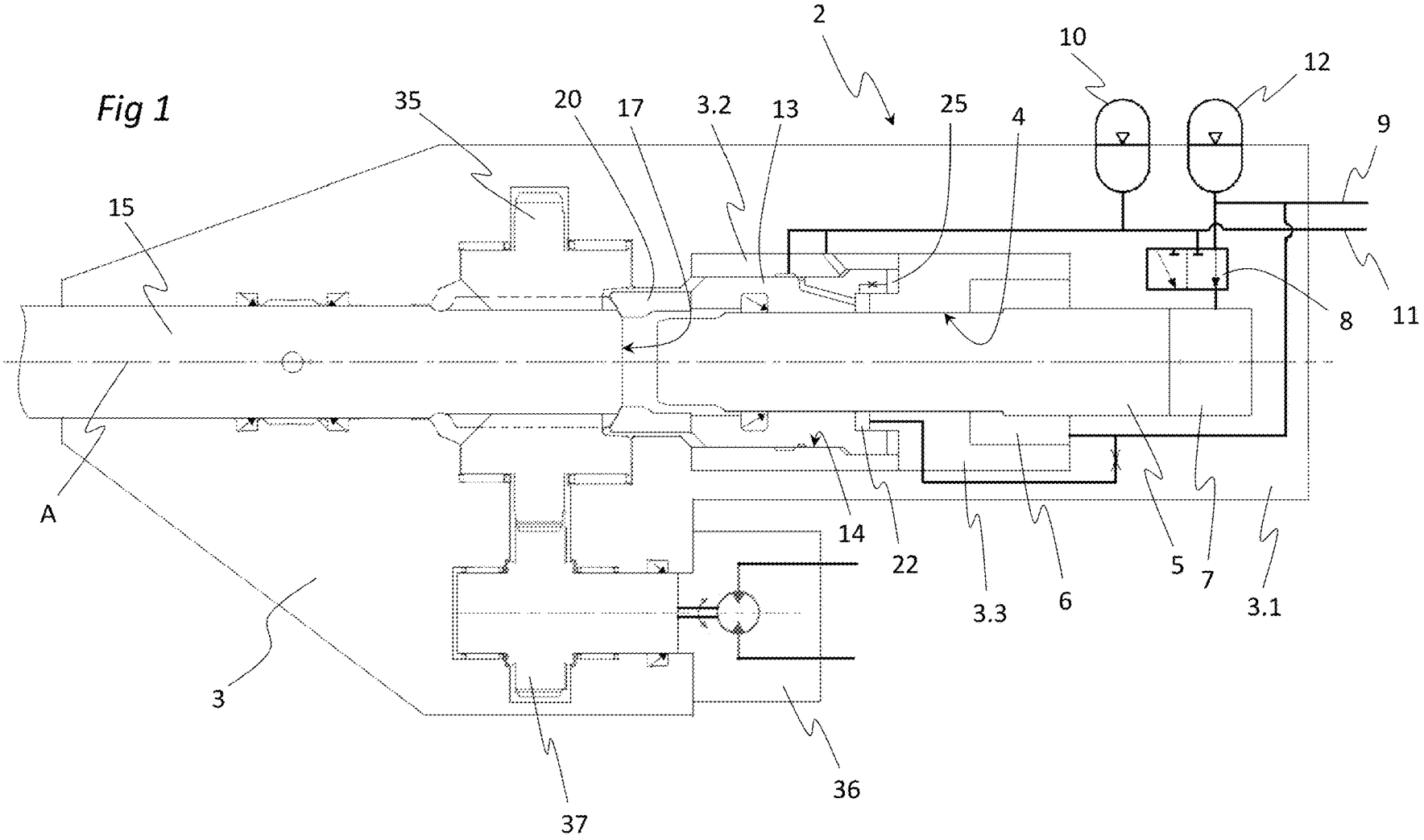
FIG. 1 is a longitudinal sectional view of a hydraulic rotary-percussive hammer drill according to a first embodiment of the invention.
Figure 2:
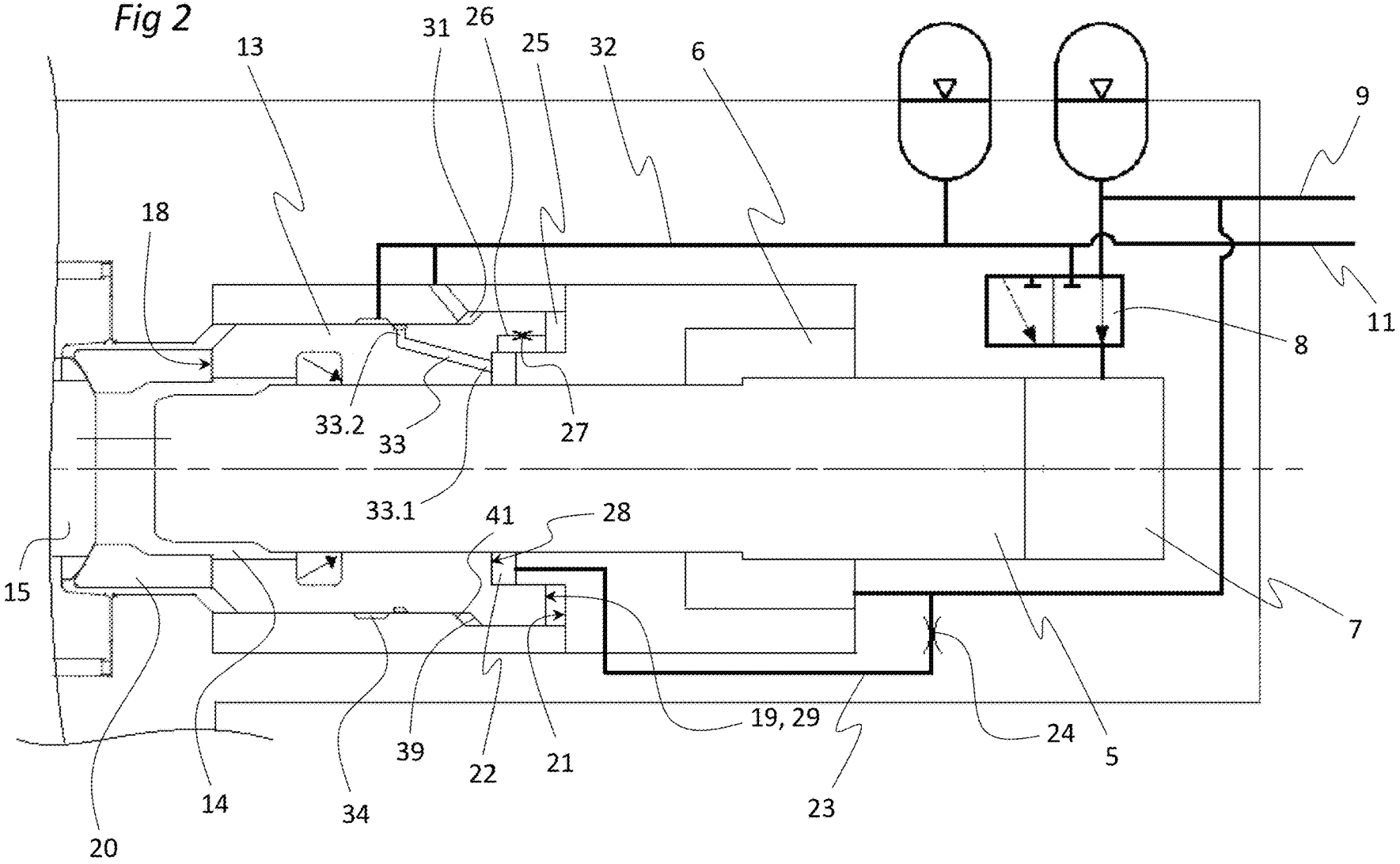
FIG. 2 is an enlarged longitudinal sectional view of a detail of FIG. 1.

FIGS. 1 and 2 represent a first embodiment of a hydraulic rotary-percussive hammer drill 2 which is intended for the perforation of mine holes, and which is provided in particular with a striking system.

More particularly, the hydraulic rotary-percussive hammer drill 2 includes a body 3 including a piston cylinder 4. According to the embodiment represented in FIGS. 1 and 2, the body 3 includes a main body 3.1 partially delimiting the piston cylinder 4, as well as a front sleeve 3.2 and a rear sleeve 3.3 forcibly mounted in a bore 3.4 delimited by the main body 3.1.

The hydraulic rotary-percussive hammer drill 2 also includes a striking system including a striking piston 5 mounted so as to alternately slide in the piston cylinder 4 along a striking axis A. As shown more particularly in FIG. 2, the striking piston 5 and the piston cylinder 4 delimit a primary control chamber 6 which is annular, and a secondary control chamber 7 which has a larger section than the primary control chamber 6 and which is antagonist to the primary control chamber 6.

The striking system of the hydraulic rotary-percussive hammer drill 2 further comprises a control distributor 8 arranged so as to control an alternating movement of the striking piston 5 inside the piston cylinder 4 alternately along a striking stroke and a return stroke. The control distributor 8 is configured to set the secondary control chamber 7, alternately in connection with a high-pressure fluid feed-in conduit 9, such as a high-pressure uncompressible fluid (for example oil) feed-in conduit, during the striking stroke of the striking piston 5, and with a low-pressure fluid return conduit 11, such as a low-pressure uncompressible fluid (for example oil) return conduit, during the return stroke of the striking piston 5. The high-pressure fluid feed-in conduit 9 and the low-pressure fluid return conduit 11 belong to a main hydraulic feed-in circuit provided on the striking system. Advantageously, the main hydraulic feed-in circuit may include a high-pressure accumulator 12 connected to the high-pressure fluid feed-in conduit 9, and a low-pressure accumulator 10 connected to the low-pressure fluid return conduit 11.

More particularly, the control distributor 8 is movably mounted in a bore formed in the body 3 between a first position (cf. FIG. 2) in which the control distributor 8 is configured to set the secondary control chamber 7 in connection with the high-pressure fluid feed-in conduit 9 and a second position in which the control distributor 8 is configured to set the secondary control chamber 7 in connection with the low-pressure fluid return conduit 11.

Advantageously, the primary control chamber 6 is permanently supplied with high-pressure fluid through a feed-in channel connected to the high-pressure fluid feed-in conduit 9, so that each position of the control distributor 8 causes the striking stroke of the striking piston 5, and then the return stroke of the striking piston 5.

The striking system of the hydraulic rotary-percussive hammer drill 2 also comprises a stop piston 13 which is tubular and which is slidably mounted in a cavity 14 of the body 3 according to an axis of displacement substantially parallel to the striking axis A and preferably coincident with the striking axis A. According to the embodiment represented in FIGS. 1 and 2, the stop piston 13 is slidably mounted around the striking piston 5, and the cavity 14 is formed in the body 3 coaxially with the piston cylinder 4.

The hydraulic rotary-percussive hammer drill 2 further includes a shank 15 intended to be coupled, in a known manner, to at least one drill bar (not represented in the figures) equipped with a tool, also called cutter. The shank 15 extends longitudinally according to the striking axis A, and includes a first end portion facing the striking piston 5 and provided with an end face 17 against which the striking piston 5 is intended to hit during each operating cycle of the hydraulic rotary-percussive hammer drill 2, and a second end portion (not represented in the figures), opposite to the first end portion, intended to be coupled to the at least one drill bar.

As shown more particularly in FIG. 2, the stop piston 13 including a front face 18 facing the shank 15 and configured to position the shank 15 in a predetermined balanced position with respect to the striking piston 4, and a rear face 19 opposite to the front face 18 and located opposite a rear wall 21 of the cavity 14. The front face 18 of the stop piston 13 is configured to apply a pushing force directly on the shank 15 or indirectly on the shank 15 through a stop bushing 20 interposed axially between the shank 15 and the stop piston 13.

The body 3 and the stop piston 13 delimit, with the striking piston 5, a first control chamber 22 permanently connected to the high-pressure fluid feed-in conduit 9 and configured to urge the stop piston 13 forwards, that is to say towards the shank 15 and therefore opposite to the rear wall 21 of the cavity 14. Advantageously, the hydraulic rotary-percussive hammer drill 2 includes a feed-in channel 23 connecting the first control chamber 22 to the high-pressure fluid feed-in conduit 9. According to the first embodiment represented in FIGS. 1 and 2, the feed-in channel 23 is provided with a calibrated feed-in orifice 24, which could for example be provided on a spray nozzle incorporated to the feed-in channel 23.

The body 3 and the stop piston 13 also delimit a second control chamber 25 which, like the first control chamber 22, is configured to urge the striking piston 13 forwards.

According to the embodiment represented in FIGS. 1 and 2, the second control chamber 25 is connected to the control chamber 22 through a fluidic communication channel 26 provided with a calibrated orifice 27, which could for example be provide on a spray nozzle incorporated to the fluidic communication channel 26. Advantageously, the second control chamber 25 is configured to be supplied with high-pressure fluid only through the fluidic communication channel 26. According to the embodiment represented in FIGS. 1 and 2, the stop piston 13 includes a first annular control surface 28, also called first annular active surface, extending perpendicularly to the axis of displacement and partially delimiting the first control chamber 22, and a second annular control surface 29, also called second annular active surface, extending perpendicularly to the axis of displacement and partially delimiting the second control chamber 25. Advantageously, the second annular control surface 29 has a surface larger than the surface of the first annular control surface 28.

The body 3 and the stop piston 13 also delimit a third control chamber 31 permanently connected to the low-pressure fluid return conduit 11, through an additional fluidic communication channel 32 opening into the third control chamber 31. The third control chamber 31 is antagonist to the first and second control chambers 22, 25, and is thus configured to urge the stop piston 13 forwards.

In addition, the hydraulic rotary-percussive hammer drill 2 comprises a connecting channel 33 configured to fluidly connect the first control chamber 22 to the low-pressure fluid return conduit 11 when the rear face 19 of the stop piston 13 is located at a distance from the rear wall 21 of the cavity 14 which is larger than a predetermined value. According to the first embodiment represented in FIGS. 1 and 2, the stop piston 13 includes the connecting channel 33, and the connecting channel 33 includes a first end portion 33.1 opening into the first control chamber 22 and a second end portion 33.2 opposite to the first end portion 33.1 and opening into an external surface of the stop piston 13. Advantageously, the second end portion 33.2 of the connecting channel 33 is adapted to be fluidly connected to an annular groove 34, which opens into the cavity 14 and which is permanently connected to the low-pressure fluid return conduit 11, when the rear face 19 of the stop piston 13 is located at a distance from the rear wall 21 of the cavity 14 which is larger than the predetermined value.

When the striking system of the hydraulic rotary-percussive hammer drill 2 is fed, the pressure established in the first control chamber 22, thanks to the flow rate of oil that has flowed through the calibrated feed-in orifice 24, urges the stop piston 13 forwards up to a position such that the connecting channel 33 opens into the annular groove 34 which is permanently connected to the low-pressure fluid return conduit 11. At that time, the stop piston 13, which is subjected, by the rock, to a force reacting to the pushing force exerted by the hydraulic rotary-percussive hammer drill 2, stops advancing, and lies in a balanced position on the edge of the outlet of the connecting channel 33 into the annular groove 34. By construction, this balanced position allows locating the shank 15 at a distance from the striking piston 5 which corresponds to a striking stroke C provided on the striking piston 5. It should be noted that the calibrated feed-in orifice 25 has advantageously a small dimension in comparison with the connecting channel 33 and with the additional fluidic communication channel 32 so that the pressure that is established in the first control chamber 22 drops very quickly when the connecting channel 33 opens into the annular groove 34.

Once the stop piston 13 has reached its balanced position, the calibrated orifice 27, with a smaller section than the calibrated feed-in orifice 24, will progressively fill with high-pressure fluid the second control chamber 25 whose pressure has dropped because of the increase in the volume of the second control chamber 25 (resulting from the advance movement of the stop piston 13) and preferably because of the presence of the calibrated orifice 27 which prevents a quick filling of the second control chamber 25.

Starting from this state, if the reaction of the rock makes the stop piston 13 recoils, the pressure in the first control chamber 22 will increase to a first pressure level higher than the feed-in pressure thanks to the presence of the calibrated feed-in orifice 24, and the pressure in the second control chamber 25 will increase to a pressure level much higher than that of the first control chamber 22 thanks to the presence of the calibrated orifice 27 whose section is smaller than that of the calibrated feed-in orifice 24. The second annular control surface 29 being larger than the first annular control surface 28, and the pressure level exerted on the second annular control surface 29 being much higher than that exerted on the first annular control surface 28, itself higher than what it would have been without the presence of the calibrated feed-in orifice 24, the advance force exerted on the stop piston 13 becomes very high, such that the recoil distance of the stop piston 13 will be short.

In the case where, starting from this state, the reaction of the rock enables the stop piston 13 to advance (in particular when the rock collapses under the impact of the striking piston 5), the two overpressures being exerted respectively on the first and second annular control surfaces 28, 29 which did not have time to be discharged via the calibrated feed-in orifice 24 and the calibrated orifice 27, the stop piston 13 undergoes a very significant instantaneous acceleration which enables it to very quickly recovers its bearing on the shank 15 via the stop bushing 20, ideally close to its balanced position. Once this balanced position is reached, the pressures in the first and second control chambers 22, 25 are quite reduced because of the quick expansion of the first and second control chambers 22, 25, consequently the stop piston 13 will undergo only but a low hydraulic force forwards, that being so in order to keep it close to its hydraulic balanced position. Once the stop piston 13 is bearing on the shank 15 via the stop bushing 20, the pressures in the first and second control chambers 22, 25 increase quickly because their volume remains substantially constant and they are force-fed with high-pressure fluid through the calibrated feed-in orifice 24 specifically calibrated in order to optimize the effectiveness of this force-feed, the hydraulic resistance to a brutal recoil of the stop piston 13 and the modulation of the pressure in the first control chamber 22.

The striking frequency of a hydraulic hammer drill generally exceeding 50 Hz, the cycle times of the striking piston 5 are very short, which allows, with the aforementioned architecture of the feed-in system of the stop piston 13, acting on the compressibility of the hydraulic fluid much more than the feed-in flow rates. This results in an excellent responsiveness of the stop piston 13 while consuming only a small volume of oil thanks to the calibrated feed-in orifice 24 and the short stroke of the stop piston 13 enabled by the second control chamber 25. Actually, the oil contained in the first control chamber 22 will flows only very little in the low-pressure fluid return conduit 11 via the opening of the connecting channel 33, because the stop piston 13 cannot be pushed further forwards relative to the hydraulic balanced position thanks to the previously-described mechanisms.

The hydraulic rotary-percussive hammer drill 2 also comprises a rotational drive system which is configured to drive the shank 15 in rotation about a rotational axis which is substantially coincident with the striking axis A. The rotational drive system includes a coupling member 35, such as a coupling pinion, which is tubular and which is disposed around the shank 15. The coupling member 35 comprises male coupling splines and female coupling splines which are coupled in rotation respectively with female and male coupling splines provided on the shank 15.

Advantageously, the coupling member 35 includes an outer peripheral gearing coupled in rotation with an output shaft of a drive motor 36, such as a hydraulic motor hydraulically fed by an external hydraulic feed-in circuit, belonging to the rotational drive system. For example, the rotational drive system may include an intermediate pinion 37 which is coupled on the one hand to the output shaft of the drive motor 36 and on the other hand to the outer peripheral gearing of the coupling member 35.

When the hydraulic rotary-percussive hammer drill 2 is operating, the shank 15 is rotated thanks to the drive motor 36, and the shank 15 receives on its end face 17 the cyclic impacts of the striking piston 5, ensured by the striking system fed by the main hydraulic feed-in circuit. At the same time, the carrier machinery on which the hydraulic rotary-percussive hammer drill 2 is mounted applies a pushing force on the drill bar, via the body 3 and the shank 15. Inside the hydraulic rotary-percussive hammer drill 2, between the body 3 and the shank 15, this pushing force is transmitted through the stop piston 13 and the stop bushing 20. Thus, the positioning of the stop piston 13 is purely hydraulic and is arranged so that the striking stroke C of the striking piston 5 is achieved.

The stop piston 13 further includes an annular bearing surface 39 configured to abut against an annular stop surface 41 provided on the body 3, so as to limit the displacement stroke of the stop piston 13 forwards, that is to say towards the shank 15. Advantageously, the annular bearing surface 39 is configured to abut against the annular stop surface 41 of the body 3 when the rear face 19 of the stop piston 13 is located at a predetermined distance from the rear wall 21 of the cavity 14, the predetermined distance being larger than the predetermined value. According to the first embodiment of the invention, the annular bearing surface 39 is inclined with respect to the axis of displacement, and partially delimits the third control chamber 31.

Figure 3:
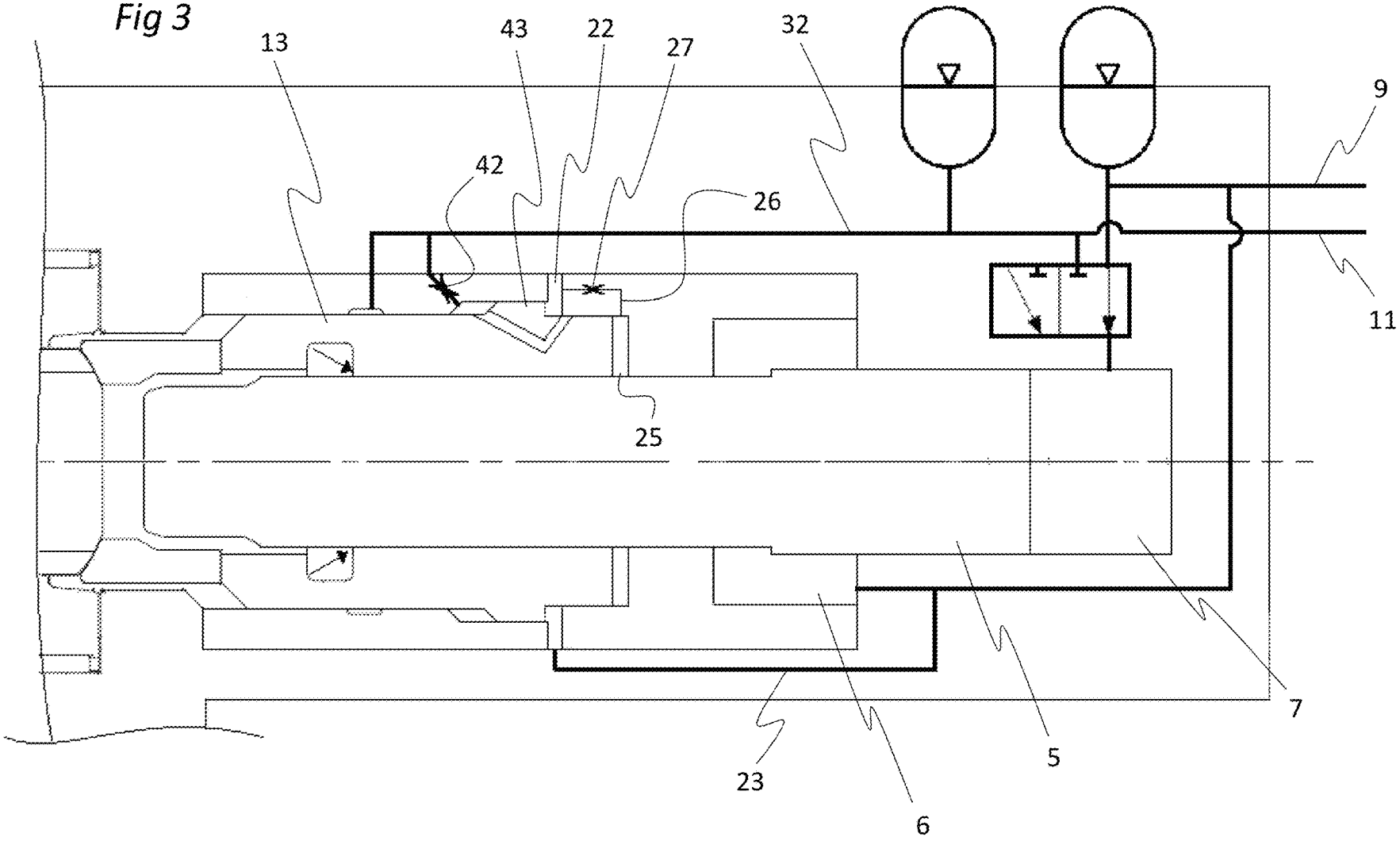
FIG. 3 is a longitudinal sectional view of a hydraulic rotary-percussive hammer drill according to a second embodiment of the invention.

FIG. 3 represents a second embodiment of the hydraulic rotary-percussive hammer drill 2 which differs from the first embodiment essentially in that the additional fluidic communication channel 32 is provided with an additional calibrated orifice 42, which could for example be provided on a spray nozzle incorporated to the additional fluidic communication channel 32, and in that the first end portion 33.1 of the connecting channel 33 opens into the third control chamber 31 and the second end portion 33.2 of the connecting cannel 33 opens into an external surface of the stop piston 13, the second end portion 33.2 of the connecting channel 33 being adapted to be fluidly connected to the first control chamber 22 when the rear face 19 of the stop piston 13 is located at a distance from the rear wall 21 of the cavity 14 which is larger than the predetermined value.

When the hydraulic rotary-percussive hammer drill 2 according to the second embodiment of the invention is operating, the first control chamber 22 is subjected to a high pressure, the stop piston 13 is displaced forwards up to the second end portion 33.2 of the connecting channel 33 opens into the first control chamber 22. The high-pressure oil then flows into the third control chamber 31 whose connection with the return channel 27 is constricted by the additional calibrated orifice 42. The first and third control chambers 22, 31 then have substantially close pressures, which reduces or cancels the forward push of the stop piston 13. Consequently, the stop piston 13 will lie in a stable operating position around this position of the second end portion 33.2 of the connecting channel 33.

Like in the first embodiment of the invention, the second control chamber 25 is connected to the first control chamber 22 via a fluidic communication channel 26 provided with a calibrated orifice 27, filling the same function as in the first embodiment. However, according to such an embodiment of the invention, the fluidic communication channel 26 is provided on the body 3, and for example on the rear sleeve 3.3.

According to the second embodiment of the invention, the stop piston 13 includes an annular collar 43, also called annular shoulder, which includes the annular bearing surface 39 and the first annular control surface 28. Thus, advantageously, the annular collar 43 delimits partially the first control chamber 22 and partially the third control chamber 31.

According to the second embodiment of the invention, the feed-in channel 23 may be devoid of any calibrated orifice, or of any other specific constriction element.

According to the second embodiment of the invention, the first control chamber 22 is delimited only by the body 3 and the stop piston 13, and the second control chamber 25 is delimited by the body 3, the stop piston 13 and the striking piston 5.

According to another embodiment of the invention, the fluidic communication channel 26 could be configured to connect the second control chamber 25 to the primary control chamber 6, always while being provided with a calibrated orifice 27.

According to another embodiment of the invention, the fluidic communication channel 26 and the calibrated orifice 27 could be formed by a calibrated axial flattened surface or a calibrated axial groove connecting either the first control chamber 22 to the second control chamber 25 or the primary control chamber 6 to the second control chamber 25. For example, the calibrated axial flattened surface or the calibrated axial groove may be provided on the body 3 or the stop piston 13.

It goes without saying that the invention is not limited to the sole embodiments of this hydraulic hammer drill, described hereinabove as examples, it encompasses on the contrary all variants thereof.

The invention claimed is:

1. A hydraulic rotary-percussive hammer drill, comprising:

a body;

a shank intended to be coupled to at least one drill bar equipped with a tool;

a striking piston slidably mounted inside the body along a striking axis and configured to hit the shank;

a stop piston which is slidably mounted in a cavity of the body according to an axis of displacement substantially parallel to the striking axis, the stop piston including a front face facing the shank and configured to position the shank in a predetermined balanced position with respect to the striking piston, and a rear face opposite to the front face and located opposite a rear wall of the cavity; and a high-pressure fluid feed-in conduit and a low-pressure fluid return conduit;

the body and the stop piston delimiting at least partially a first control chamber permanently connected to the high-pressure fluid feed-in conduit and configured to urge the stop piston forwards, the hydraulic rotary-percussive hammer drill further comprising a connecting channel configured to fluidly connect the first control chamber to the low-pressure fluid return conduit when the rear face of the stop piston is located at a distance from the rear wall of the cavity which is larger than a predetermined value, wherein the body and the stop piston further delimiting at least partially a second control chamber configured to urge the stop piston forwards, and wherein the hydraulic rotary-percussive hammer drill comprises a fluidic communication channel which opens into the second control chamber and which is configured to supply the second control chamber with high-pressure fluid, the fluidic communication channel being provided with a calibrated orifice.

2. The hydraulic rotary-percussive hammer drill according to claim 1 further comprising, a main hydraulic feed-in circuit configured to control an alternating sliding of the striking piston according to the striking axis.

3. The hydraulic rotary-percussive hammer drill according to claim 2, wherein the main hydraulic feed-in circuit is further configured to control a sliding of the stop piston according to the axis of displacement, the main hydraulic feed-in circuit including the high-pressure fluid feed-in conduit and the low-pressure fluid return conduit.

4. The hydraulic rotary-percussive hammer drill according to claim 3, wherein the body and the striking piston delimit at least partially a primary control chamber permanently connected to the high-pressure fluid feed-in conduit and a secondary control chamber which is antagonist to the primary control chamber, the hydraulic rotary-percussive hammer drill further including a control distributor configured to fluidly connect the secondary control chamber alternately to the high-pressure fluid feed-in conduit and to the low-pressure fluid return conduit so as to control striking and return strokes of the striking piston.

5. The hydraulic rotary-percussive hammer drill according to claim 4, wherein the second control chamber is permanently connected to the primary control chamber via the fluidic communication channel.

6. The hydraulic rotary-percussive hammer drill according to claim 1, wherein the second control chamber is permanently connected to the first control chamber via the fluidic communication channel.

7. The hydraulic rotary-percussive hammer drill according to claim 1, wherein the stop piston includes a first annular control surface extending transversely to the axis of displacement and delimiting at least partially the first control chamber and a second annular control surface extending transversely to the axis of displacement and delimiting at least partially the second control chamber.

8. The hydraulic rotary-percussive hammer drill according to claim 1, wherein the body and the stop piston also delimit at least partially a third control chamber permanently connected to the low-pressure fluid return conduit, the third control chamber being antagonist to the first control chamber and the second control chambers.

9. The hydraulic rotary-percussive hammer drill according to claim 1, wherein the stop piston includes the connecting channel.

10. The hydraulic rotary-percussive hammer drill according to claim 9, wherein the connecting channel includes a first end portion opening into the first control chamber and a second end portion opposite to the first end portion and opening into an external surface of the stop piston, the second end portion of the connecting channel being adapted to be fluidly connected to the low-pressure fluid return conduit when the rear face of the stop piston is located at a distance from the rear wall of the cavity which is larger than the predetermined value.

11. The hydraulic rotary-percussive hammer drill according to claim 9, wherein the body and the stop piston also delimit at least partially a third control chamber permanently connected to the low-pressure fluid return conduit, the third control chamber being antagonist to the first control chamber and the second control chamber and the connecting channel includes a first end portion opening into the third control chamber and a second end portion opposite to the first end portion and opening into an external surface of the stop piston, the second end portion of the connecting channel being adapted to be fluidly connected to the first control chamber when the rear face of the stop piston is located at a distance from the rear wall of the cavity which is larger than the predetermined value.

12. The hydraulic rotary-percussive hammer drill according to claim 1, which includes a feed-in channel connecting the first control chamber to the high-pressure fluid feed-in conduit, the feed-in channel being provided with a calibrated feed-in orifice.

13. The hydraulic rotary-percussive hammer drill according to claim 1, wherein the stop piston is slidably mounted around the striking piston.

14. The hydraulic rotary-percussive hammer drill according to claim 1, further including a stop bushing disposed axially between the shank and the front face of the stop piston.

15. The hydraulic rotary-percussive hammer drill according to claim 1, wherein the fluidic communication channel and the calibrated orifice are formed by an axial groove or an axial flattened surface which is provided on the stop piston or on the body, and which connects the first control chamber to the second control chamber.

16. The hydraulic rotary-percussive hammer drill according to claim 1, wherein the fluidic communication channel includes a spray nozzle comprising the calibrated orifice.

17. The hydraulic rotary-percussive hammer drill according to claim 4, wherein the second control chamber is permanently connected to the first control chamber via the fluidic communication channel.

18. The hydraulic rotary-percussive hammer drill according to claim 17, wherein the stop piston includes a first annular control surface extending transversely to the axis of displacement and delimiting at least partially the first control chamber and a second annular control surface extending transversely to the axis of displacement and delimiting at least partially the second control chamber.

19. The hydraulic rotary-percussive hammer drill according to claim 18, wherein the body and the stop piston also delimit at least partially a third control chamber permanently connected to the low-pressure fluid return conduit, the third control chamber being antagonist to the first control chamber and the second control chamber.

20. The hydraulic rotary-percussive hammer drill according to claim 19, wherein the stop piston includes the connecting channel.

* * * * *